US008122811B2

(12) United States Patent
Takamizawa et al.

(10) Patent No.: US 8,122,811 B2
(45) Date of Patent: Feb. 28, 2012

(54) FUEL INJECTION PUMP AND METHOD FOR ASSEMBLING THE SAME

(75) Inventors: Satoru Takamizawa, Kariya (JP); Katsumi Mori, Chiryu (JP); Atsushi Sano, Toyoake (JP); Takafumi Naitou, Kariya (JP)

(73) Assignee: Denso Corporation, Kariya (JP)

( * ) Notice: Subject to any disclaimer, the term of this patent is extended or adjusted under 35 U.S.C. 154(b) by 684 days.

(21) Appl. No.: 12/259,383

(22) Filed: Oct. 28, 2008

(65) Prior Publication Data

US 2009/0120280 A1 May 14, 2009

(30) Foreign Application Priority Data

Nov. 12, 2007 (JP) ..... 2007-293596
Jun. 24, 2008 (JP) ..... 2008-164965

(51) Int. Cl.
*F02M 59/44* (2006.01)
*F04B 9/04* (2006.01)

(52) U.S. Cl. ..... 92/72; 92/153

(58) Field of Classification Search ..... 92/72, 153
See application file for complete search history.

(56) References Cited

U.S. PATENT DOCUMENTS 6,139,284 A 10/2000 Streicher
6,615,799 B2 9/2003 Mori et al.
6,722,864 B2 * 4/2004 Suzuki et al. ..... 92/72
6,872,056 B2 3/2005 Stiefel
6,910,407 B2 * 6/2005 Furuta ..... 92/72
7,270,047 B2 9/2007 Furuta
2002/0033167 A1 3/2002 Hiraku et al.
2003/0089343 A1 5/2003 Yamaguchi et al.
2005/0106035 A1 5/2005 Aoki et al.
2005/0106049 A1 5/2005 Aoki et al.
2006/0280620 A1 12/2006 Kleinbeck et al.

FOREIGN PATENT DOCUMENTS

JP 2008-184953 8/2008

OTHER PUBLICATIONS

Japanese Office Action dated Oct. 20, 2009, issued in corresponding Japanese Application No. 2008-164965, with English translation.

* cited by examiner

*Primary Examiner* — Thomas E Lazo
(74) *Attorney, Agent, or Firm* — Nixon & Vanderhye PC

(57) ABSTRACT

A housing has a cylinder and a compression chamber. A plunger is slidable in the cylinder and configured to pressurize fuel in the compression chamber. A cam is eccentric with respect to a shaft center axis of a camshaft and integrally rotatable with the camshaft. A sliding member is slidable around an outer circumferential periphery of the cam and configured to revolve around the shaft center axis in conjunction with rotation of the camshaft. The plunger is slidable on the sliding member and configured to convert the revolution into a linear movement. The cam and the sliding member are accommodated in the housing. The sliding member has an opening through which the outer circumferential periphery is partially exposed.

14 Claims, 13 Drawing Sheets

FUEL INJECTION PUMP AND METHOD FOR ASSEMBLING THE SAME

CROSS REFERENCE TO RELATED APPLICATIONS

This application is based on and incorporates herein by reference Japanese Patent Applications No. 2007-293596 filed on Nov. 12, 2007 and No. 2008-164965 filed on Jun. 24, 2008.

FIELD OF THE INVENTION

The present invention relates to a fuel injection pump for an internal combustion engine. The present invention further relates to a method for assembling the fuel injection pump.

BACKGROUND OF THE INVENTION

U.S. Pat. No. 6,615,799 B2 (JP-A-2002-310039) discloses a fuel injection pump including a camshaft, a cam, a sliding member, and a plunger. The cam is eccentric with respect to the camshaft. The sliding member is slidable and rotatable with respect to the outer circumferential periphery of the cam. The plunger is configured to pressurize and feed fuel in a compression chamber.

The cam is eccentric with respect to the center axis of the camshaft and rotatable integrally with the camshaft. The sliding member revolves around the center axis of the camshaft in conjunction with rotation of the camshaft. The plunger as a sliding member is slidable and configured to convert revolution of the sliding member into a reciprocal movement. In the present structure, the plunger conducts the reciprocal movement so as to pressurize and feed fuel in the fuel compression chamber.

More specifically, U.S. Pat. No. 6,615,799 B2 discloses a three-cylinder fuel injection pump including a housing, which has three cylinders and three fuel compression chambers, and three plungers each slidable in each cylinder and configured to pressurize and feed fuel drawn into the fuel compression chamber. The sliding member is in a ring shape and entirely surrounds the outer circumferential periphery of the cam. The sliding member is in a hexagonal shape having straight and arc-shaped outlines. The three plungers are located at intervals of 120 degrees, and having a straight outline slidably in contact with the sliding member. In the present structure, the sliding member has three sliding surfaces located at intervals of 120 degrees. The three plungers alternately pump fuel in the three compression chambers in conjunction with rotation of the camshaft. According to U.S. Pat. No. 6,615,799 B2, the outer circumferential periphery of the cam has a groove to lead lubricate oil into a sliding portion between the outer circumferential periphery of the cam and the sliding member.

In recent years, increase in discharge pressure of a fuel injection pump is demanded. When the discharge pressure is increased, surface pressure applied to the sliding portion between the cam and the sliding member becomes high. Therefore, supply of sufficient fuel is required to the sliding portion. However, in the structure of U.S. Pat. No. 6,615,799 B2, the sliding member is in a ring shape and entirely surrounds the outer circumferential periphery of the cam. Accordingly, it is hard to supply sufficient fuel to the sliding portion.

SUMMARY OF THE INVENTION

In view of the foregoing and other problems, it is an object to produce a fuel injection pump configured to lead sufficient fuel into a sliding portion. It is another object of the present invention to produce a method for assembling the fuel injection pump.

According to one aspect of the present invention, a fuel injection pump comprises a housing having a cylinder and a compression chamber. The fuel injection pump further comprises a plunger slidable in the cylinder and configured to pressurize fuel in the compression chamber. The fuel injection pump further comprises a camshaft. The fuel injection pump further comprises a cam eccentric with respect to a shaft center axis of the camshaft and integrally rotatable with the camshaft. The fuel injection pump further comprises a sliding member slidable around an outer circumferential periphery of the cam and configured to revolve around the shaft center axis in conjunction with rotation of the camshaft. The plunger is slidable on the sliding member and configured to convert the revolution into a linear movement. The cam and the sliding member are accommodated in the housing. The sliding member has an opening through which the outer circumferential periphery is partially exposed.

According to another aspect of the present invention, a method for assembling a fuel injection pump, the method comprises inserting a cam of a camshaft into a sliding member. The method further comprises moving the cam around a shaft center axis and moving the sliding member around an outer circumferential periphery of the cam by applying moment caused by mass of the cam and the sliding member so as to position the cam and the sliding member at a specified rotative position. The method further comprises accommodating the cam and the camshaft in a housing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
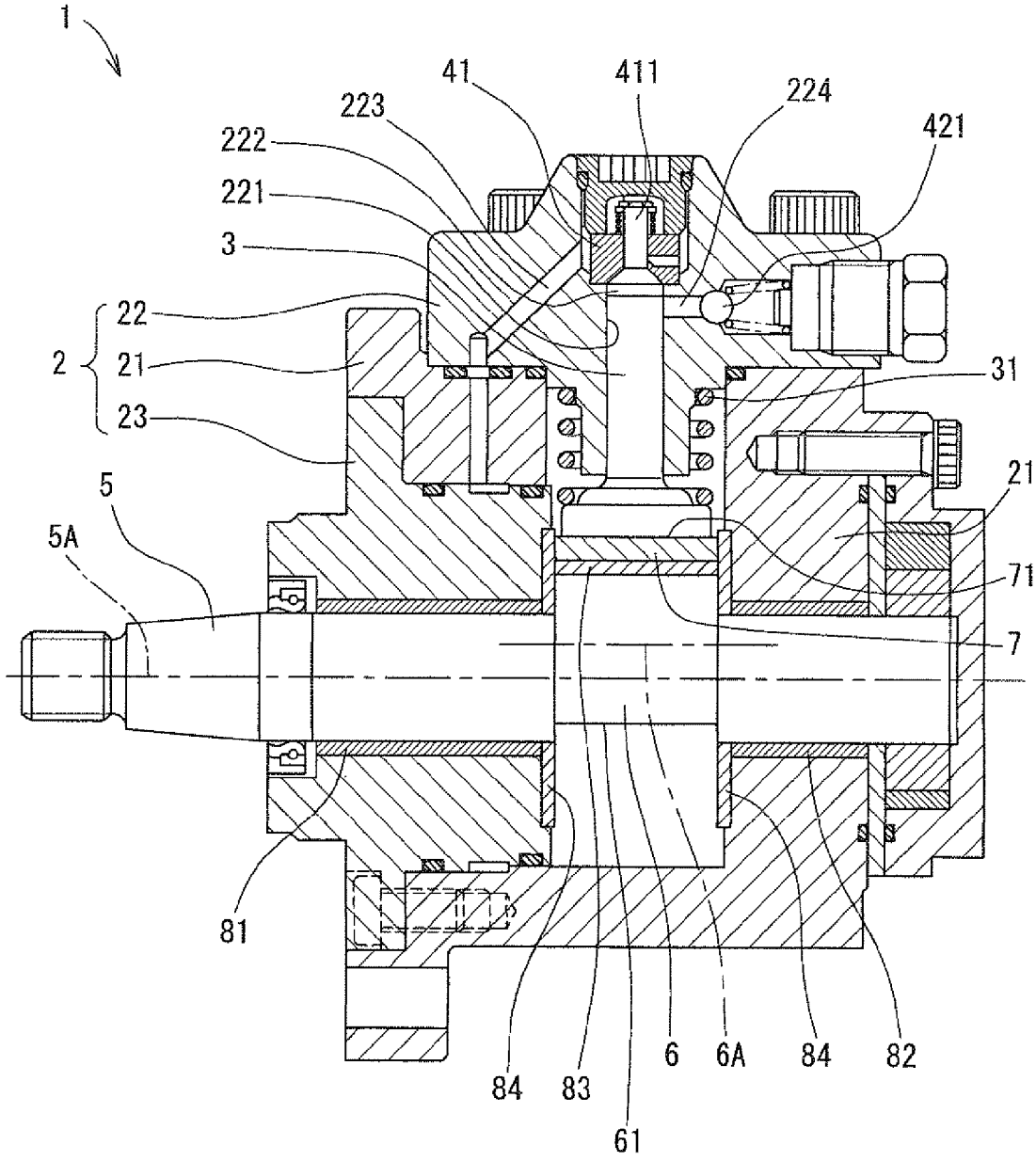
FIG. 1 is a longitudinal sectional view showing a fuel injection pump according to an embodiment.
Figure 2:
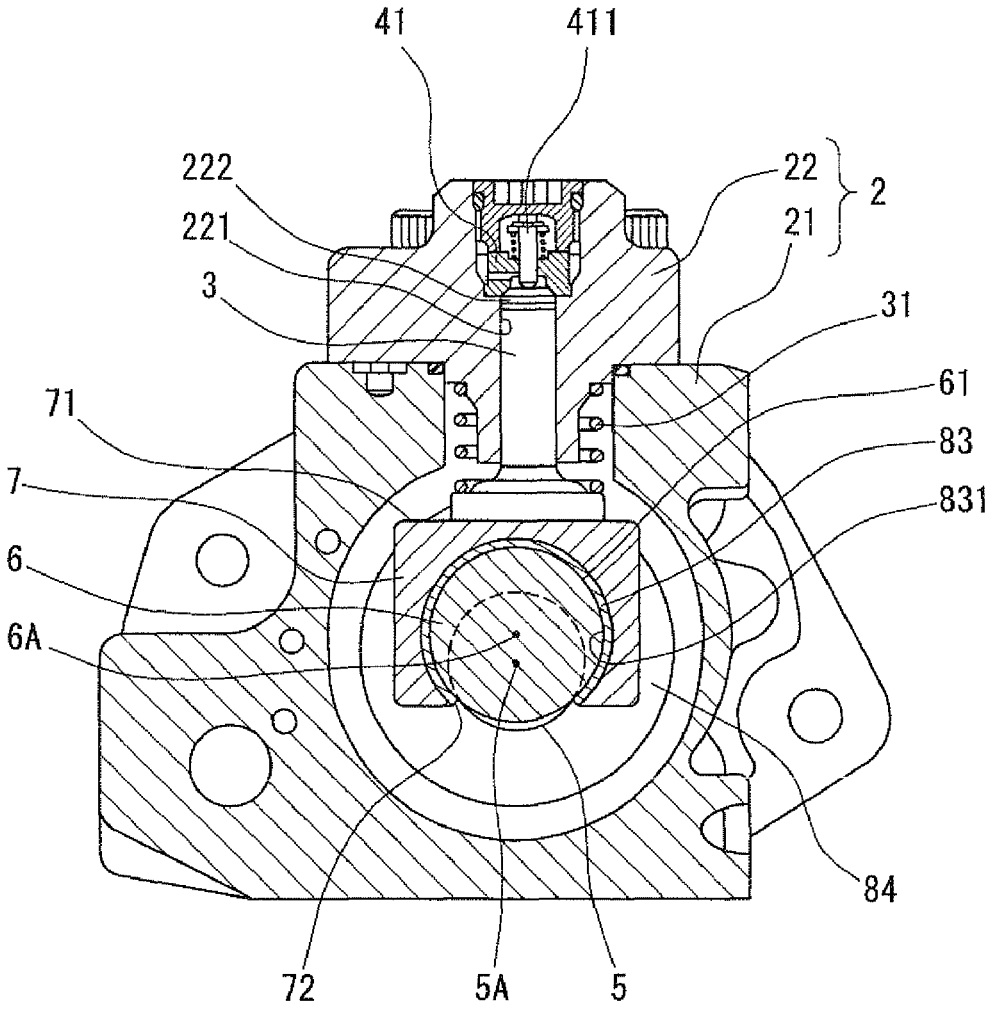
FIG. 2 is an axial sectional view showing the fuel injection pump according to the embodiment.

As shown in FIGS. 1, 2, a fuel injection pump 1 is a single-cylinder fuel injection pump including a housing 2, which has one cylinder 221 and one fuel compression chamber 222, and a plunger 3, which is for pressurizing and feeding fuel drawn into the fuel compression chamber. The fuel injection pump 1 includes a camshaft 5, a cam 6, and a sliding member 7, in addition to the housing 2 and the plunger 3.

The housing 2 includes a housing body 21, a cylinder head 22, and a bearing cover 23. The cylinder 221 is defined in the cylinder head 22. The fuel compression chamber 222 is defined by the inner surface of the cylinder head 22, the end surface of a check valve member 411 of a check valve 41, and the end surface of the plunger 3.

The bearing cover 23 is fixed to the housing body 21 via a bolt. A metal bush 81, which is accommodated in the bearing cover 23, and a metal bush 82, which is accommodated in the housing body 21, configure a bearing of the camshaft 5. The bearing cover 23 and the camshaft 5 therebetween define an oil seal. The camshaft 5 is accommodated in the housing body 21 and the bearing cover 23. In the present structure, the camshaft 5 is rotatably supported by the metal bushes 81, 82.

Figure 3A:
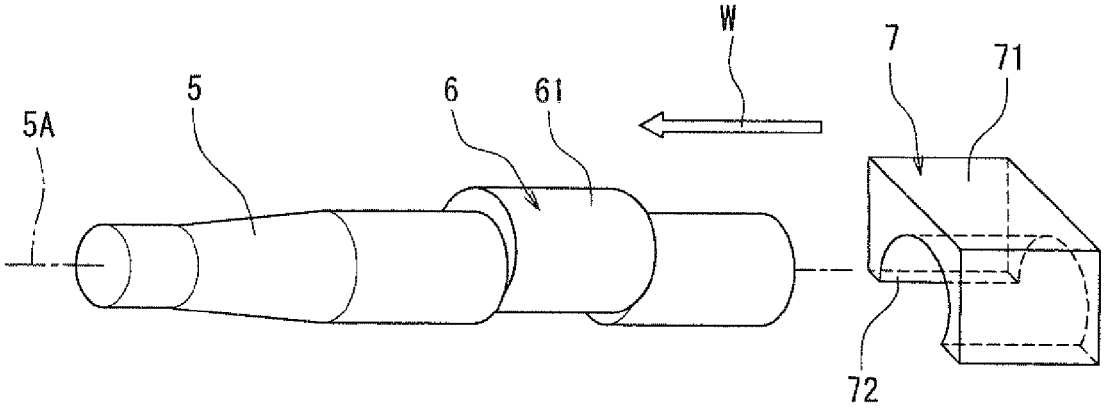
FIG. 3A is a perspective view showing a camshaft and a sliding member of the fuel injection pump.

As shown in FIG. 3A, the cam 6 has an outer circumferential periphery 61 as a cylinder lateral side substantially defining a circular cam profile. The cam 6 is eccentric with respect to a shaft center axis 5A of the camshaft 5. In the present structure, the shaft center axis 5A of the camshaft 5 is shifted from a cam center axis 6A of the cam 6, and rotatable together with the camshaft 5. Each of the inner walls of the housing body 21 and the bearing cover 23 is provided with an annular sliding plate 84, which is slidable relative to the axial end surface of the cam 6.

Figure 3B:
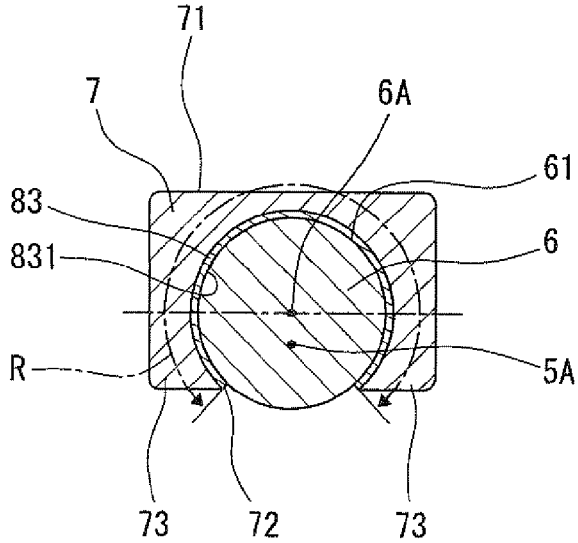
FIG. 3B is an axial sectional view showing a cam and the sliding member.

The sliding member 7 surrounds the outer circumferential periphery 61 of the cam 6, and is rotatable and slidable relative to the outer circumferential periphery 61 of the cam 6. As shown in FIG. 3A, the sliding member 7 is substantially in a C-shape in cross section. The sliding member 7 is assembled to the cam 6 in the direction of arrow W along the shaft center axis 5A. The sliding member 7 has an opening 72, which is configured to partially expose a part of the outer circumferential periphery 61 of the cam 6 with respect to the circumferential direction of the sliding member 7. That is, the opening 72 is provided in a portion of the sliding member 7 in the circumferential direction of the sliding member 7. The opening 72 extends through the sliding member 7 in the direction of the shaft center axis 5A. As shown in FIG. 3B, the sliding member 7 has both tip ends 73 at the side of the opening 72, and both the tip ends 73 extend along the outer circumferential periphery 61 of the cam 6. In the present structure, the sliding member 7 surrounds a part of the outer circumferential periphery 61, which is shown by the arrow R and longer than the semicircle thereof.

A metal bush (bearing member) 83 is press-fitted to the inner circumferential periphery of the sliding member 7 excluding the opening 72. In the present structure, the sliding member 7 is slidable and rotatable relative to the outer circumferential periphery 61 of the cam 6. In an actual structure, the sliding member 7 is press-fitted with the metal bush 83, and thereafter the sliding member 7 together with the metal bush 83 is assembled to the cam 6. In FIG. 3A, the metal bush 83 is omitted so as to simplify the drawing. The metal bush 83 configures a part of a sliding member. The inner sliding surface of the metal bush 83 defines a sliding surface 831 as a rotary sliding portion between the outer circumferential periphery 61 of the cam 6 and the sliding member 7.

The sliding member 7 has a sliding surface 71, which is located on the opposite side of the opening 72 and slidably in contact with the plunger 3. The sliding surface 71 is substantially in a planar shape and configured to reduce contact pressure when sliding relative to the part of the plunger 3, which is in contact with the sliding surface 71. As shown in FIG. 2, in the present structure including the camshaft 5, the cam 6, the metal bush 83, and the sliding member 7, the sliding member 7 revolves around the shaft center axis 5A to perform an orbital motion in conjunction with the motion of the cam 6, which is accompanied with the rotation of the camshaft 5. The sliding member 7 is rotatable with respect to the cam 6. The cam 6 rotates in the sliding member 7, while the sliding member 7 is held by the plunger 3 and restricted from rotating.

The plunger 3 is biased from a spring 31 at the side of the sliding member 7. In the present structure, the plunger 3 is in contact with the sliding surface 71 of the sliding member 7 such that the plunger 3 is slidable with respect to the sliding member 7 in the horizontal direction in FIG. 2. In the present structure, the plunger 3 moves in response to the revolution of the sliding member 7, thereby converting the revolution of the sliding member 7 into the movement in the vertical direction in FIG. 2. Thus, the plunger 3 slides in the cylinder 221 in the vertical direction in FIG. 1 and pressurizes fuel drawn from a fuel inlet passage 223 to feed the fuel into the fuel compression chamber 222 through the check valve 41. The check valve 41 is configured to restrict fuel from reverse flowing from the fuel compression chamber 222 to the fuel inlet passage 223.

The fuel pressurized in the fuel compression chamber 222 is supplied from a fuel discharge passage 224 to a common rail (not shown) through a fuel pipe. A check valve member 421 is provided to the fuel discharge passage 224 to configure a check valve. The present check valve is configured to restrict fuel from reverse flowing from the discharge passage 224 to the fuel compression chamber 222.

Figure 4A:
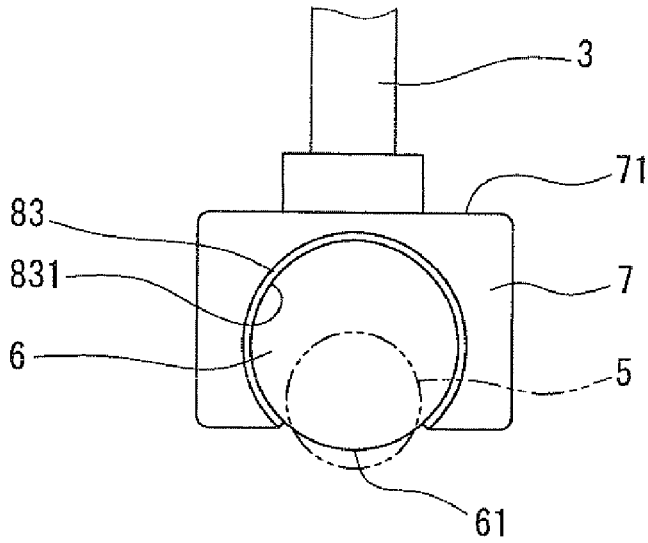
FIGS. 4A, 4B are views each showing a sliding surface between the cam and the sliding member.
Figure 4B:
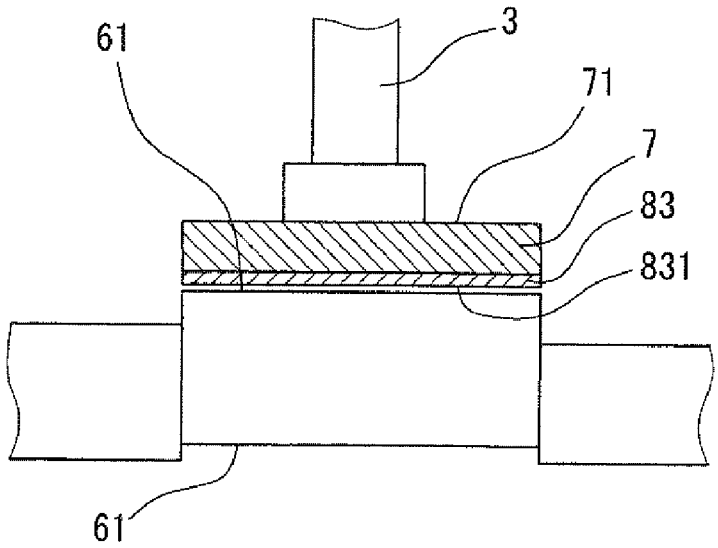

In FIG. 2, the cam 6 and the sliding member 7 are accommodated in the housing body 21 of the housing 2, and submerged in fuel as lubricant filled in the interior of a housing body 211. As described above, the sliding member 7 is rotatable and slidable with respect to the outer circumferential periphery 61 of the cam 6 and provided with the opening 72, through which the outer circumferential periphery 61 is partially exposed. In the present structure, the outer circumferential periphery 61 of the cam 6 at the lower side in FIG. 4 can be directly submerged in the lubricating oil through the opening 72. The lubricating oil being in contact with the outer circumferential periphery 61 at the lower side is directly fed to the sliding surface 831 between the outer circumferential periphery 61 of the cam 6 and the sliding member 7 accompanied with the rotation of the cam 6 with respect to the sliding member 7. Whereby, the lubricating oil can be sufficiently fed to the sliding surface 831. In FIG. 4A, the camshaft 5 is indicated by the two-dot chain line in order to make the drawing easily viewable.

Figure 5A:
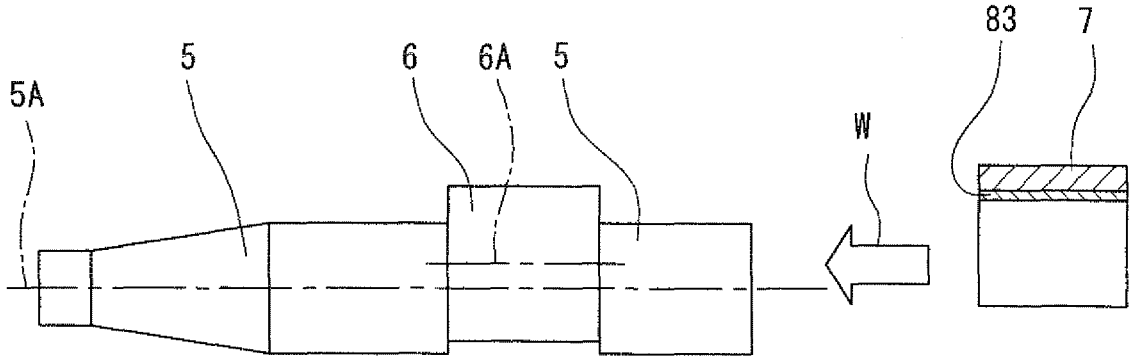
FIGS. 5A, 5B are partially sectional views each showing the sliding member assembled to the cam.
Figure 5B:
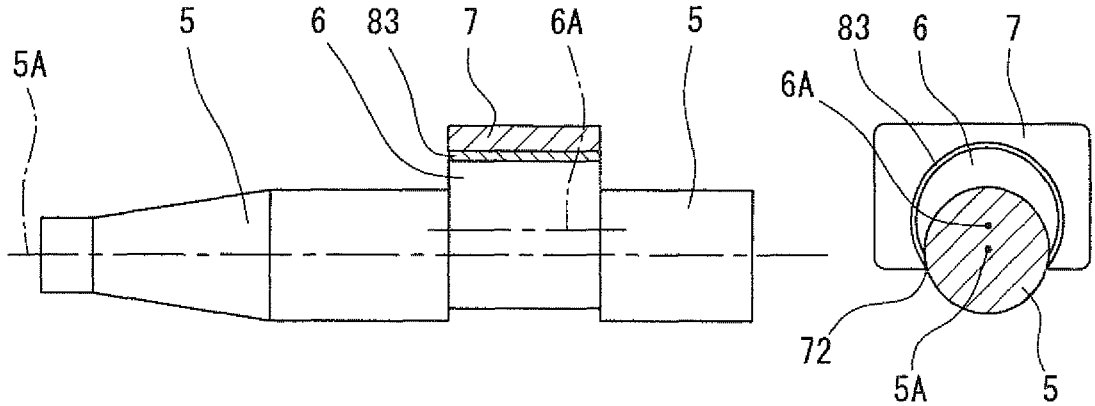

In addition, as described above, the opening 72 extends through a part of the sliding member 7, the part being a portion of the sliding member 7 with respect to the circumferential direction of the sliding member 7. The opening 72 extends substantially in the direction of the shaft center axis 5A. As shown in FIG. 5B, as the shaft center axis 5A is shifted from the cam center axis 6A and the camshaft 5 projects from the cam 6 with respect to the radial direction, the diameter of the circumscribed circle of the camshaft 5 becomes large. Even in this case, as shown in FIG. 5B, the portion of the camshaft 5 may be projected from the cam 6 through the opening 72 to the lower side in FIG. 5B, thereby being released through the opening 72. Thus, the camshaft 5 does can be restricted from causing interference with the sliding member 7 when the sliding member 7 is mounted to the cam 6 along the arrow W. Therefore, in the present structure, the diameter of the circumscribed circle of the camshaft 5 may be enlarged.

Figure 6A:
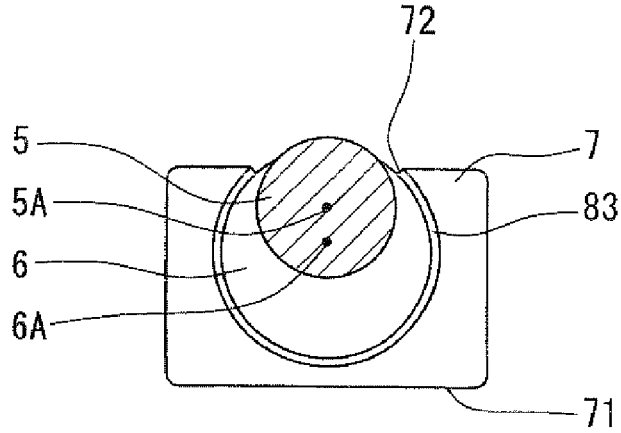
FIGS. 6A, 6B are views each showing the camshaft and the sliding member, which are assembled to each other.
Figure 6B:
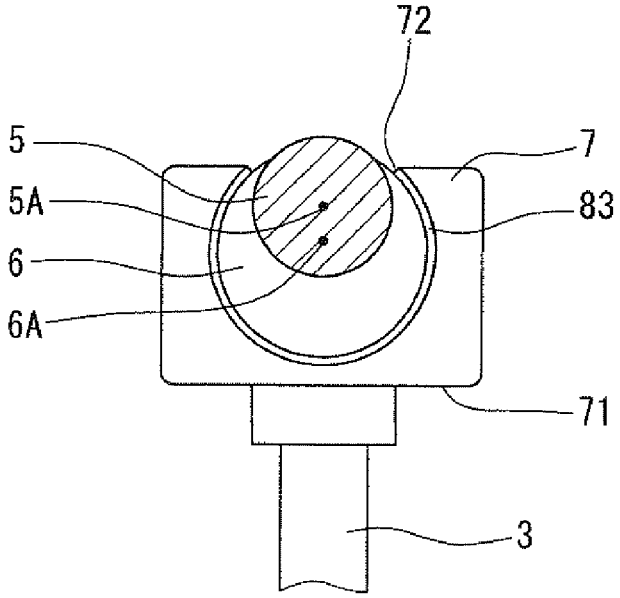

Further, when the camshaft 5 is rotatably held by the housing 2, the camshaft 5 automatically rotates around the shaft center axis 5A toward the ground at the lower side in FIG. 6A by being applied with moment. The moment is caused by the mass of the cam 6 and exerted to the cam center axis 6A as the center of gravity of the cam 6 around the shaft center axis 5A. As described above, the opening 72 is located at the opposite side of the sliding surface 71. In the present structure, the sliding member 7, which is rotatable around the outer circumferential periphery 61 of the cam 6, automatically (spontaneously) rotates by being applied with the moment caused by the mass of the sliding member 7. Specifically, the center of the gravity of the sliding member 7 is applied with the moment, so that the sliding member 7 automatically rotates around the cam center axis 6A, such that the sliding surface 71 is located at the side of the ground at the lower side in FIG. 6A. Thus, as shown in FIG. 6A, the rotation of both the cam 6 and the sliding member 7 results in automatically positioning of the sliding surface 71 steadily at the side of the ground at the lower side in FIG. 6A with respect to the shaft center axis 5A. Therefore, the sliding surface 71 of the sliding member 7 can be automatically positioned with respect to the housing 2. Thus, positioning work of both the plunger 3 and the sliding member 7 when the plunger 3 is mounted to the housing 2 can be omitted. In the present structure, the plunger 3 may be mounted from the lower side in FIG. 6B toward the sliding surface 71, which is automatically positioned with respect to the housing 2.

As described above, both the tip ends 73 of the sliding member 7 at the side of the opening 72 extend along the outer circumferential periphery 61 of the cam 6. In the present structure, the sliding member 7 surrounds the part of the outer circumferential periphery 61. The part of the outer circumferential periphery 61 is shown by the arrow R and longer than the semicircle of the cam 6. In the present structure, the sliding member 7 can be steadily rotatable and slidable on the outer circumferential periphery 61 of the cam 6 without being detached radially from the cam 6.

Further, as described above, the sliding surface 71 is located at the opposite side of the opening 72. In the present structure, the plunger 3 can be steadily in contact with the sliding surface 71 of the sliding member 7, while influence caused by the opening 72 is further reduced. Accordingly, revolution of the sliding member 7 can be further steadily converted into the sliding motion of the plunger 3, so that fuel drawn into the fuel compression chamber 222 can be further steadily pressurized and fed.

As described above, the fuel injection pump 1 according to the present embodiment includes the housing 2, which has the cylinder 221 and the fuel compression chamber 222, and the plunger 3, which is configured to slide in the cylinder 221 so as to pressurize and feed fuel drawn into the fuel compression chamber 222. The fuel injection pump 1 further includes the camshaft 5, the cam 6, and the sliding member 7. The cam 6 is eccentric with respect to the shaft center axis 5A of the camshaft 5 and integrally rotatable with the camshaft 5. The sliding member 7 surrounds the outer circumferential periphery 61 of the cam 6 and has the opening 72 through which the outer circumferential periphery 61 is partially exposed. The sliding member 7 is rotatable and slidable around the outer circumferential periphery 61 and configured to revolve around the shaft center axis 5A in conjunction with rotation of the camshaft 5. The cam 6 and the sliding member 7 are accommodated in the housing 2. The plunger 3 is slidable on the sliding member 7 and configured to convert revolution of the sliding member 7 into the reciprocal movement (linear movement).

According to the present structure, the fuel injection pump, which can lead sufficient lubricating oil to the rotary sliding portion, can be produced.

Modification

Figure 7:
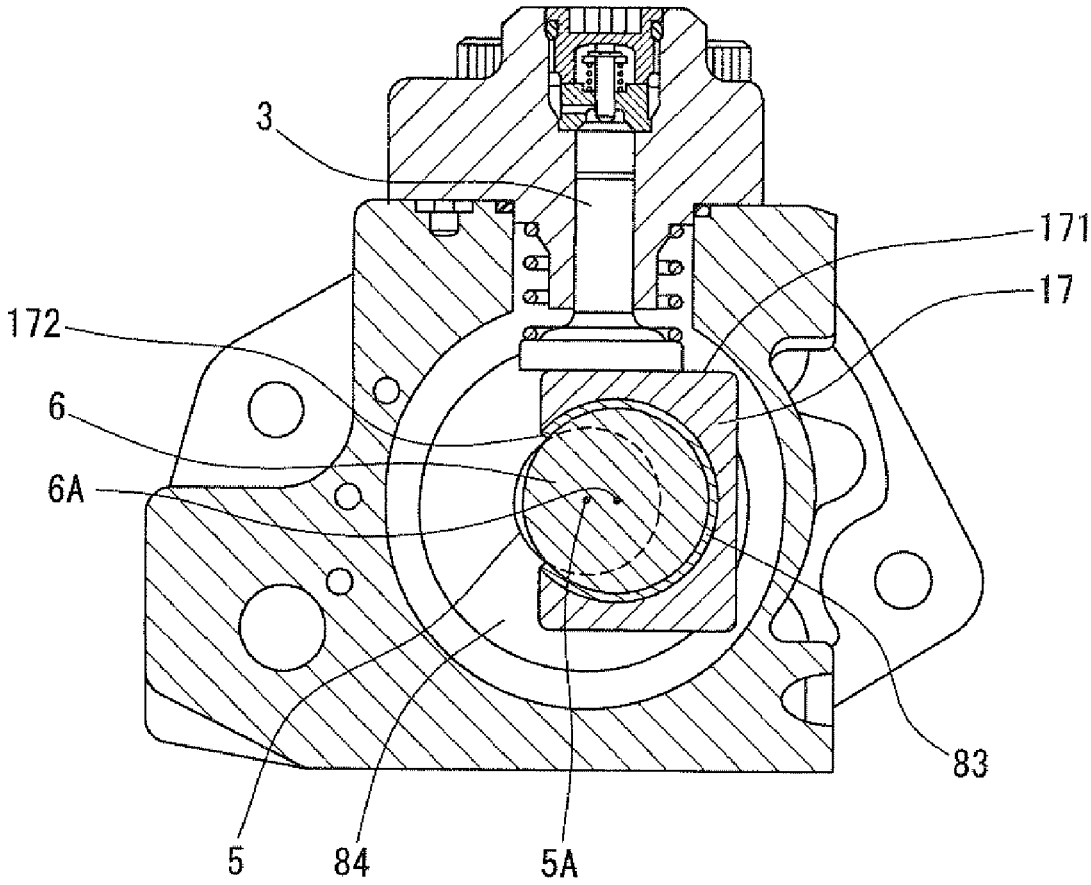
FIG. 7 is an axial sectional view showing a modification of the fuel injection pump shown in FIG. 2.

In the above embodiment, a sliding surface 171, on which the plunger 3 is slidable, is provided at the opposite side of the opening 72. Alternatively, as shown in FIG. 7, a sliding member 17 may be provided instead of the sliding member 7. The sliding member 17 has an opening 172 at a substantially right-angle position with respect to the sliding surface 171.

In the present embodiment, the fuel injection pump 1 is a single-cylinder pump having the single cylinder, and hence the number of the sliding surface 71, 171 is one. In the present structure, the position of the opening is not limited to the position shown in FIGS. 2, 7, and may be determined at another position, as long as the sliding surface 71, 171 does not interfere with the opening 72, 172. As described above, the opening 72 is preferably located at the opposite side of the sliding surface 71. Alternatively, as shown in FIG. 7, the opening 172 may be located at the position other than the opposite side of the sliding surface 171. In this case, influence caused by the opening 172 can be further reduced by increasing the thickness of the sliding member 17 in the radial direction, or elongating the portion shown by the arrow R in FIG. 3B. Thus, in the present structure, the plunger 3 can be steadily maintained in contact with the sliding surface 171 of the sliding member 17.

Figure 8A:
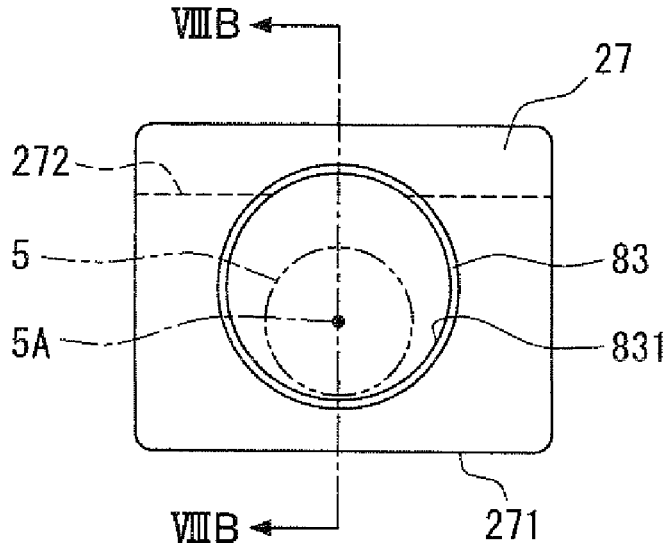
FIG. 8A is a front view showing a first modification of the sliding member shown in FIG. 2.
Figure 8B:
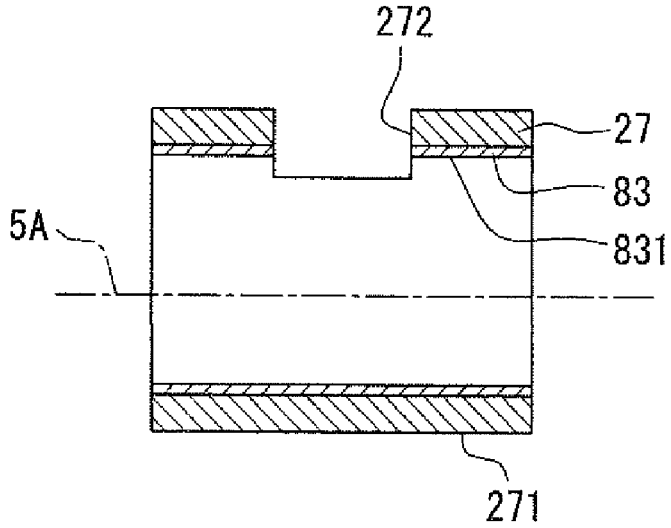
FIG. 8B is a sectional view taken along the line VIIIB-VIIIB in FIG. 8A.
Figure 9A:
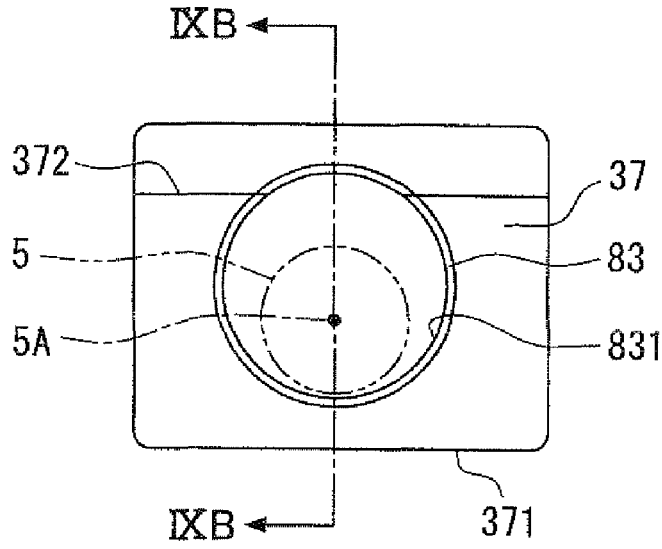
FIG. 9A is a front view showing a second modification of the sliding member shown in FIG. 2.
Figure 9B:
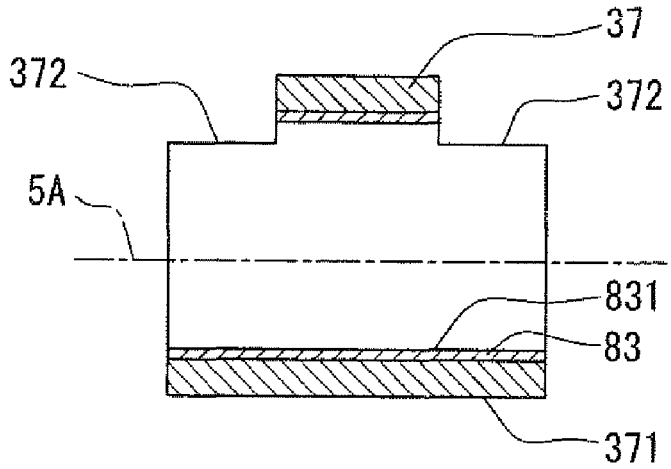
FIG. 9B is a sectional view taken along the line IXB-IXB in FIG. 9A.

In addition, in the above embodiment, the opening 72, 172 extends through the part of the sliding member 7, the part being the portion of the sliding member 7 with respect to the circumferential direction of the sliding member 7. The opening 72 extends substantially in the direction of the shaft center axis 5A. The opening is not limited to the structure described above. For example, as shown in FIGS. 8A to 9B, a sliding member 27, 37 may be provided instead of the sliding member 7, 17. The sliding member 7, 17 has an opening 272, 372, which extends substantially perpendicularly to the shaft center axis 5A through a part of the sliding member 27, 37, the part of the sliding member 27, 37 being a portion in the direction of the shaft center axis 5A. As shown in FIG. 8B, the opening 272 is located substantially at the center of the sliding member 27 in the direction of the shaft center axis 5A. As shown in FIG. 9B, the opening 372 is located substantially at both ends of the sliding member 37 in the direction of the shaft center axis 5A.

In the above-described sliding member 7, 17, the sliding surface 831 is not defined throughout the circumference. By contrast, in the sliding member 27, the sliding surface 831 is defined throughout in the circumferential direction at both end sides with respect to the direction of the shaft center axis 5A, and hence the sliding member 27 entirely surrounds both the ends in the circumferential direction. In the sliding member 37, the sliding surface 831 is defined throughout in the circumferential direction at the center with respect to the direction of the shaft center axis 5A, and hence the sliding member 37 entirely surrounds the center in the circumferential direction. Therefore, lubricating oil can be sufficiently fed to the rotary sliding portion, compared with the sliding member 7, 17, while the strength of the sliding member 27, 37 is enhanced.

Figure 10A:
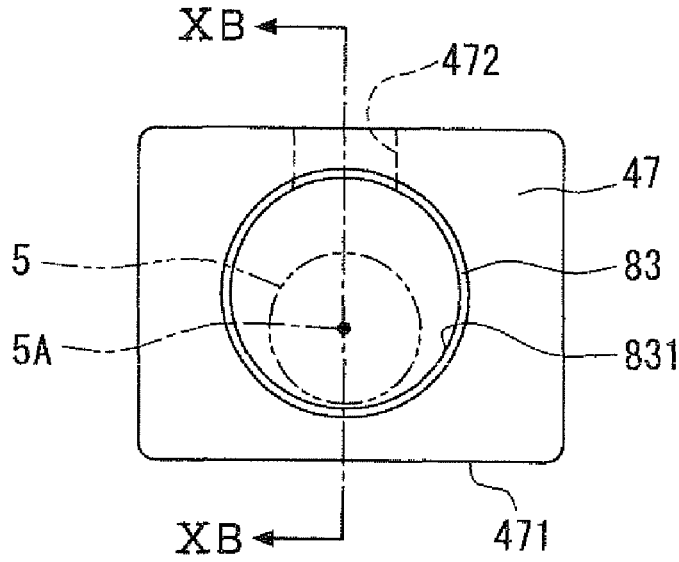
FIG. 10A is a front view showing a third modification of the sliding member shown in FIG. 2.
Figure 10B:
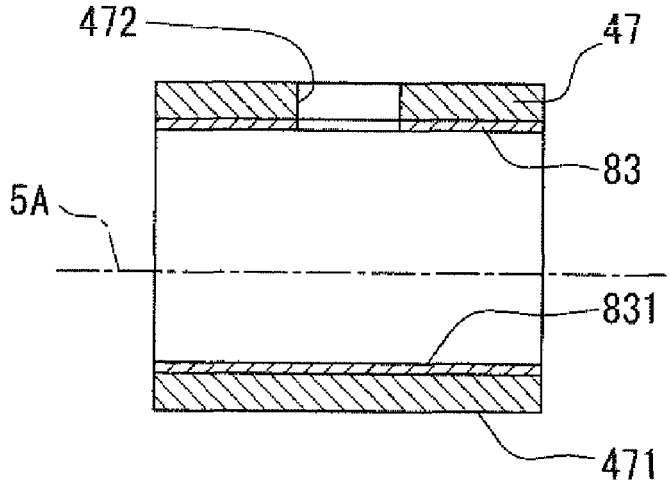
FIG. 10B is a sectional view taken along the line XB-XB in FIG. 10A.

In the above embodiments, the opening 72,172,272,372 extends in the direction of the shaft center axis 5A or in the direction perpendicular to the shaft center axis 5A. The direction of the opening 72,172,272,372 is not limited to the above embodiments. For example, as shown in FIG. 10, a sliding member 47 may be provided with an opening 472, instead of the sliding member 7, 17, 27, 37. The opening 472 does not extend throughout in both the direction of the shaft center axis 5A and the direction perpendicular to the shaft center axis 5A, i.e., the circumferential direction of the opening 472. In the present structure, the substantially annular opening 472 extends through the sliding surface 831 substantially in the radial direction of the sliding surface 831. Therefore, the sliding surface 831 is provided throughout the circumference excluding the opening 472, and the sliding member 47 surrounds circumferentially throughout the sliding surface 831. Therefore, lubricating oil can be sufficiently fed to the rotary sliding portion, compared with the sliding member 7, 17, while the strength of the sliding member 47 is enhanced.

In FIGS. 8, 10, the opening 272, 372, 472 is provided on the opposite side of sliding surface 271, 371, 471, on which the plunger 3 is slidable. The structure is not limited to that shown in FIGS. 8, 19. An opening may be provided as long as the sliding surface 271, 371, 471 does not interfere with the opening.

Figure 11A:
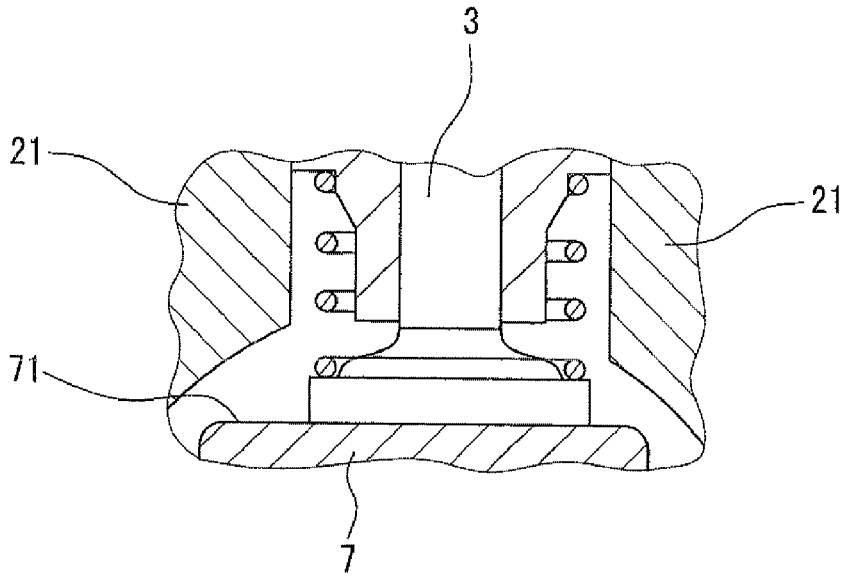
FIG. 11A is an enlarged view showing the plunger in FIG. 2.
Figure 11B:
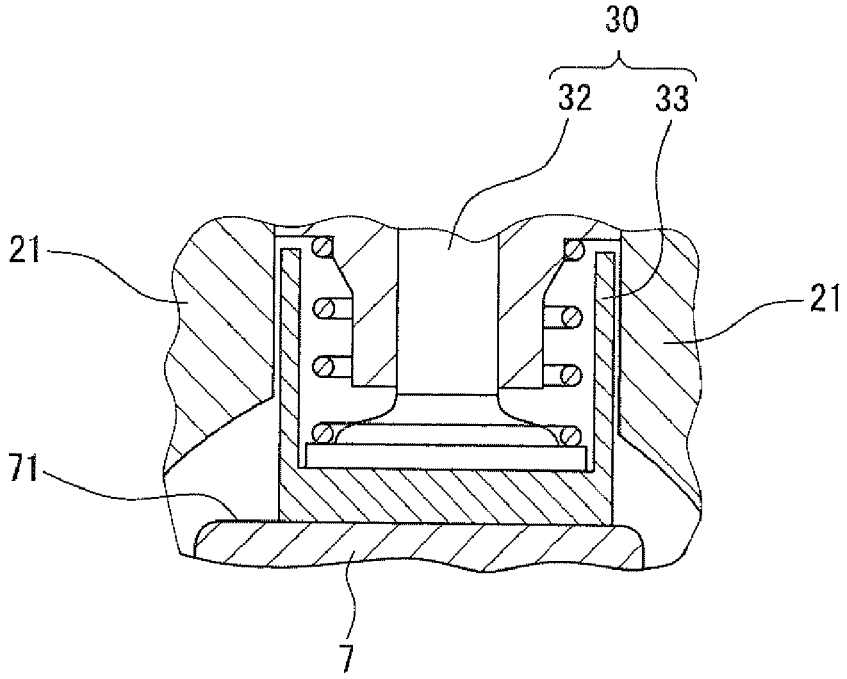
FIG. 11B is an axial sectional view showing a modification of the plunger shown in FIG. 11A.

In the above embodiments, the plunger 3 is directly in contact with the sliding member 7 as shown in FIG. 11A. The structure is not limited to that shown in FIG. 11A. As shown in FIG. 11B, a plunger 30 may be provided, instead of the plunger 3. The plunger 30 includes a plunger body 32 and a tappet 33, which are separate components. The tappet 33 is a converting member. The tappet 33 is in a C-shape in cross section. The tappet 33 is slidable on the sliding surface 71 of the sliding member 7, thereby configured to convert the revolution of the sliding member 7 to the reciprocal movement. In addition, the tappet 33 is directly in contact with the plunger body 32, thereby reciprocally moving the plunger body 32. In the present structure, the tappet 33 is capable of suppressing stress exerted from the sliding member 7 to the plunger body 32 when the plunger 3 converts the revolution of the sliding member 7 into the reciprocal movement.

More specifically, the plunger 3 indicated in FIG. 11A receives the sharing force, which causes ineffective stress, directly from the sliding member 7 in the horizontal direction in FIG. 11A. By contrast, in the plunger 3 indicated in FIG. 11B, the tappet 33 receives the sharing force from the sliding member 7 in the horizontal direction in FIG. 11B. In the present structure, the housing body 21 on both sides of the tappet 33 can receive the sharing force from the tappet 33. Therefore, the tappet 33 is capable of suppressing the sharing force exerted from the sliding member 7 to the plunger body 32.

In the above embodiments, the present structure is applied to the single-cylinder fuel injection pump 1 having a single-cylinder structure including the single plunger and the housing, which has the single cylinder and the single fuel compression chamber. The present structure is not limited to be applied to the single-cylinder fuel injection pump 1. The present structure may be applied to a multi-cylinder fuel injection pump including a housing, which has multiple cylinders and multiple fuel compression chambers, and multiple plungers, which are for compressing fuel drawn into the fuel compression chambers and press-feeding the fuel.

Figure 12:
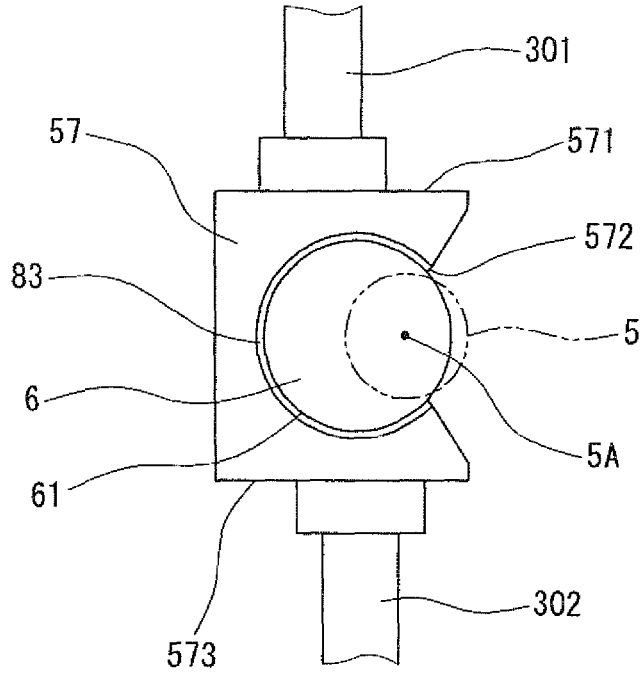
FIG. 12 is a view showing a first modification of the plunger and the sliding member shown in FIG. 4A.

FIG. 12 shows an example of the present structure applied to a two-cylinder fuel injection pump. The plunger 301 is slidably in contact with the sliding surface 571 of a sliding member 57. A plunger 302 is slidably in contact with the sliding surface 573 of the sliding member 57. The sliding surface 573 is located on the opposite side of the sliding surface 571. As described above, the sliding member 57 rotates around the shaft center axis 5A in conjunction with the rotation of the camshaft 5. In the present structure, the plungers 301, 302 are slidably in contact respectively with the sliding surfaces 571, 573 of the sliding member 57, thereby converting the revolution of the sliding member 57 into the reciprocal movement in the vertical direction in FIG. 12. The plungers 301, 302 reciprocate in the vertical direction in FIG. 12, thereby pumping fuel respectively drawn into two compression chambers (not shown) and press-feeding the fuel.

The opening 572 is located at the location substantially perpendicular to both the sliding surfaces 571, 573. Specifically, the sliding surface of the sliding member 7 is located at a rotative position perpendicular to a rotative position of the opening 72, 172 with respect to the cam center axis 6A of the cam 6. In the present structure, the plungers 301, 302 are slidably in contact with the sliding member 57 respectively at the sliding surfaces 571, 573, which are out of the opening 572 in the sliding member 57. In the present structure, the plungers 301, 302 are configured to convert the revolution of the sliding member 57 into the reciprocal movement further steadily, while reducing influence of the opening 572.

Even in the present two-cylinder fuel injection pump, the outer circumferential periphery 61 of the cam 6 can be partially submerged in lubricating oil directly through the opening 572. Thus, lubricating oil can be sufficiently led to the rotary sliding portion between the outer circumferential periphery 61 of the cam 6 and the sliding member 57.

Figure 13:
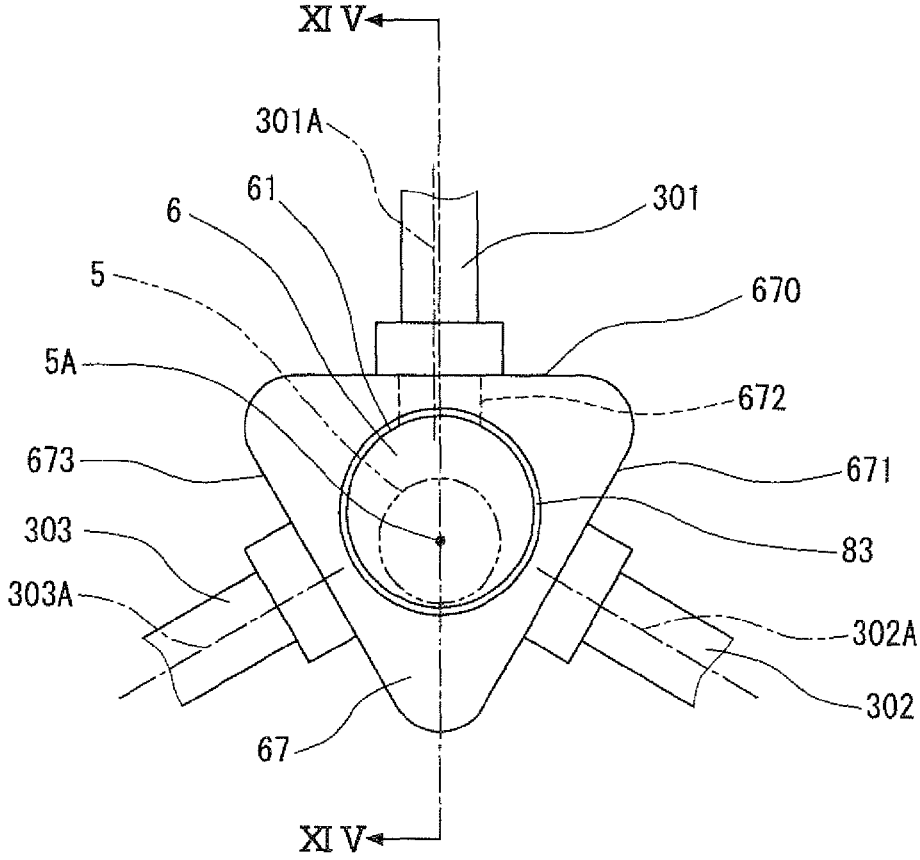
FIG. 13 is a view showing a second modification of the plunger and the sliding member shown in FIG. 4A.
Figure 14:
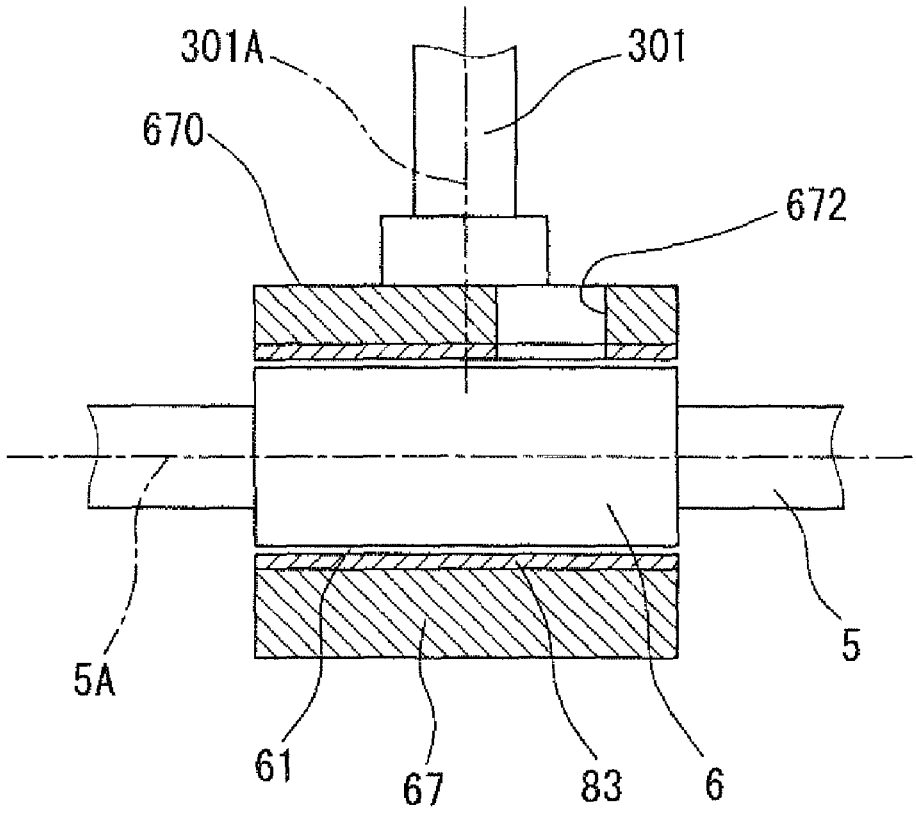
FIG. 14 is a partially sectional view taken along the line XIV-XIV in FIG. 13.

FIGS. 13, 14 show an example of the present structure applied to a three-cylinder fuel injection pump. A plunger 301 is slidably in contact with a sliding surface 670 of a sliding member 67. The plunger 302 is slidably in contact with a sliding surface 671 of the sliding member 67. A plunger 303 is slidably in contact with a sliding surface 673 of the sliding member 67. As described above, the sliding member 67 rotates around the shaft center axis 5A in conjunction with the rotation of the camshaft 5.

Therefore, the plunger 301 is slidably in contact with the sliding surface 670 of the sliding member 67, thereby converting the revolution of the sliding member 67 into the reciprocal movement in the direction of a center axis 301A of the plunger 301. The plunger 302 is slidably in contact with the sliding surface 671 of the sliding member 67, thereby converting the revolution of the sliding member 67 into the reciprocal movement in the direction of a center axis 302A of the plunger 302. The plunger 303 is slidably in contact with the sliding surface 673 of the sliding member 67, thereby converting the revolution of the sliding member 67 into the reciprocal movement in the direction of a center axis 303A of the plunger 303. The plungers 301, 302, 303 respectively reciprocate in the directions of the center axes 301A, 302A, 303A, thereby compressing fuel drawn into three compression chambers (none shown) and press-feeding the fuel.

An opening 672 is provided in the sliding surface 670. The opening 672 is, for example, in an annular shape. Dissimilarly to the above embodiments, the plunger 301 is slidably in contact with the sliding member 67 at a portion of the sliding surface 670 in which the opening 672 is defined in the sliding member 67. The present structure is defined, since the plunger is hard to be slidably in contact with the sliding member at a location out of the opening in the sliding member 67, dissimilarly to the embodiments shown in FIGS. 4A, 12.

In the present embodiment shown by FIGS. 13, 14, the center of the opening 672 is shifted from the center axis 301A of the plunger 301 to the right side in FIG. 14 so as to reduce influence caused by the opening 672. In the present structure, the plunger 301 is capable of steadily in contact with the sliding surface 670 of the sliding member 67. Thus, the outer circumferential periphery 61 of the cam 6 can be partially submerged directly into lubricate oil through the opening 672.

Even in the present three-cylinder fuel injection pump, the outer circumferential periphery 61 of the cam 6 can be partially submerged in lubricating oil directly through the opening 672. Thus, lubricating oil can be sufficiently led to the rotary sliding portion between the outer circumferential periphery 61 of the cam 6 and the sliding member 67.

FIG. 14 is a partial cross sectional view showing cross sections of only the sliding member 67 and the metal bush 83 for simplifying the view.

The present invention may include a method for assembling the fuel injection pump. For example, the method includes inserting the cam 6 of the camshaft 5 into the sliding member 7; moving the cam 6 around the shaft center axis 5A and the sliding member 7 around the outer circumferential periphery of the cam 6 by applying moment caused by mass of the cam 6 and the sliding member 7 so as to position the cam 6 and the sliding member 7 at a specified rotative position; accommodating the cam 6 and the camshaft 5 in the housing 2; and inserting the plunger 3 into the cylinder 221 of the housing z from the lower side of the housing 2 in the gravitation direction to make contact with the sliding surface of the sliding member 7 located at the lower side.

The above structures of the embodiments can be combined as appropriate. Various modifications and alternations may be diversely made to the above embodiments without departing from the spirit of the present invention.

What is claimed is:

1. A fuel injection pump comprising:

a housing having a cylinder and a compression chamber;

a plunger slidable in the cylinder and configured to pressurize fuel in the compression chamber;

a camshaft;

a cam eccentric with respect to a shaft center axis of the camshaft and integrally rotatable with the camshaft; and a sliding member slidable around an outer circumferential periphery of the cam and configured to revolve around the shaft center axis in conjunction with rotation of the camshaft, wherein the plunger is slidable on the sliding member and configured to convert the revolution into a linear movement, the cam and the sliding member are accommodated in the housing, and the sliding member has an opening through which the outer circumferential periphery of the cam is partially exposed, the opening is provided in the sliding member in a circumferential direction of the sliding member, and the opening extends through and along the sliding member, continuously from one axial end of the sliding member to an other axial end of the sliding member in a direction of the shaft center axis.

2. The fuel pump according to claim 1, wherein the sliding member has both tip ends extending along the outer circumferential periphery of the cam at a respective side of the opening, and the sliding member surrounds a portion of the outer circumferential periphery of the cam longer than a semicircle of the outer circumferential periphery of the cam.

3. The fuel injection pump according to claim 1, wherein the plunger is slidable on a portion of the sliding member remote from the opening.

4. The fuel injection pump according to claim 3, wherein said portion of the sliding member is located on an opposite side of the sliding member with respect to the opening in the sliding member.

5. The fuel injection pump according to claim 1, wherein the plunger includes a converting member, the converting member is slidable on the sliding member and configured to convert the revolution of the sliding member into the linear movement, and the plunger body is slidable on the converting member and configured to perform the linear movement.

6. The fuel injection pump according to claim 1, wherein the cylinder has a single cylinder cavity, the compression chamber has a single chamber, the plunger has a single plunger element, and the cylinder, the compression chamber, and the plunger construct a single-cylinder structure.

7. The fuel injection pump according to claim 1, wherein the sliding member has a sliding surface on which the plunger is slidable, and the sliding surface is located at a rotative position perpendicular to a rotative position of the opening with respect to a cam center axis of the cam.

8. The fuel injection pump according to claim 1, wherein the sliding member has two sliding surfaces on each of which the plunger is slidable, and each of the two sliding surfaces is located at a rotative position perpendicular to a rotative position of the opening with respect to a cam center axis of the cam.

9. The fuel injection pump according to claim 1, wherein the sliding member has three sliding surfaces on each of which the plunger is slidable, and the three sliding surface are located at intervals of 120 degrees with respect to a cam center axis of the cam.

10. The fuel injection pump according to claim 1, wherein the cam is inserted into the sliding member along the shaft center axis.

11. The fuel injection pump according to claim 1, wherein the sliding member is integrally formed.

12. The fuel injection pump according to claim 11, wherein the sliding member has an inner circumferential periphery provided with a bearing member, and the sliding member is rotatable around the cam via the bearing member.

13. The fuel pump according to claim 1, wherein the cam is partially projected from the sliding member through the opening.

14. A fuel injection pump comprising:

a housing having a cylinder and a compression chamber;

a plunger slidable in the cylinder and configured to pressurize fuel in the compression chamber;

a camshaft;

a cam eccentric with respect to a shaft center axis of the camshaft and integrally rotatable with the camshaft; and a sliding member slidable around an outer circumferential periphery of the cam and configured to revolve around the shaft canter axis in conjunction with rotation of the camshaft, wherein the plunger is slidable on the sliding member and configured to convert the revolution into a linear movement, the cam and the sliding member are accommodated in the housing, the sliding member has an opening through which the outer circumferential periphery is partially exposed, the plunger is slidable on a portion of the sliding member outside the opening, and the portion of the slidable member is located on an opposite side of the opening in the sliding member.

* * * * *